US005690392A

United States Patent [19]

Clapham

[11] Patent Number: 5,690,392

[45] Date of Patent: Nov. 25, 1997

[54] WATER SUPPLY SYSTEM FOR A MINING MACHINE

[75] Inventor: William Stephan Clapham, Ecclesfield, England

[73] Assignee: Hydra Tools International PLC, S. Yorkshire, England

[21] Appl. No.: 648,172

[22] PCT Filed: Nov. 16, 1994

[86] PCT No.: PCT/GB94/02518

§ 371 Date: May 17, 1996

§ 102(e) Date: May 17, 1996

[87] PCT Pub. No.: WO95/14846

PCT Pub. Date: Jun. 1, 1995

[30] Foreign Application Priority Data

Nov. 20, 1993 [GB] United Kingdom ..... 9323945

[51] Int. Cl.[6] ..... E21C 35/23

[52] U.S. Cl. ..... 299/81.1; 299/81.2

[58] Field of Search ..... 299/17, 81.1, 81.2, 299/81.3

[56] References Cited

U.S. PATENT DOCUMENTS 4,718,730 1/1988 Unger ..... 299/81.1 X

FOREIGN PATENT DOCUMENTS 189393 1/1986 European Pat. Off. .
8800173 3/1988 Germany .
2058176 8/1981 United Kingdom .
2198196 6/1988 United Kingdom .

*Primary Examiner*—David J. Bagnell
*Attorney, Agent, or Firm*—Trexler, Bushnell, Giangiorgi & Blackstone, Ltd.

[57] ABSTRACT

A water supply system for a mining machine (1) of the continuous miner type comprises at least one rotatable mineral cutting drum (5); at least one water supply arm (9) adapted, in use, to extend forwardly from the mining machine (1) and terminating in a ring (6), the internal periphery (10) of which ring (6) is in close proximity to a portion of the external or internal arcuate periphery (53, 52) of the cutting drum (5). A circumferential water supply chamber (44) is defined between the internal periphery (10) of the ring (6) and the portion of the drum; and water seating means (32) extends between the ring (6) and the portion of the drum (5) to minimise water leakage from the chamber (44). A water delivery port (45) is provided in the or each water delivery arm (9) for supplying pressurized water from a remote supply source to the chamber (44); and a water distribution network (38–41) of the drum (5) is in water flow communication with the chamber (44). The invention also includes a mining machine (1) provided with such a water supply system.

28 Claims, 6 Drawing Sheets

WATER SUPPLY SYSTEM FOR A MINING MACHINE

This invention relates to a water supply system for a mining machine, and to a mining machine provided with such a system.

Mining machines of the so-called continuous miner type, comprising a crawler chassis with one elevatable drive arm, or a pair of spaced-apart, elevatable drive arms pivotable about a common transverse axis, projecting from the front of the chassis, and carrying a plurality of mineral cutting drums which in turn carry an array of cutter picks, with the drums being rotatable about the transverse axis, and consisting of a centre drum between the arms and two end drums.

With other types of mining machine a standard feature is the provision of a supply of pressurized water to spray nozzles located in the vicinity of the picks for various purposes such as dust suppression, incendive sparking shrouding and pre-start warning, but the provision of such a water supply feature on a continuous miner is not without technical difficulties and has largely been avoided, with a simple transverse spray bar provided for dust supression purposes. However, in one design of continuous miner a water supply has been provided along a co-axial drive shaft of the drums, but the integrity of water seals is critical as seal failure results in contamination of the associated gearbox and their eventual failure, with consequent loss of mineral production and considerable repair costs. Consequently, seals of the highest quality, and cost, are essential.

A basic object of the present invention is to provide an improved water supply system for a continuous type mining machine, in which any water seal leakage or failure is of little or no consequence.

According to a first aspect of the present invention there is provided a water supply system for a mining machine of the continuous miner type, the system comprising (i) at least one rotatable mineral cutting drum;

(ii) at least one water supply arm adapted, in use, to extend forwardly from the mining machine and terminating in a ring, an internal or external operational periphery of which ring is in close proximity respectively to an external or internal portion of the operational arcuate periphery of the cutting drum;

(iii) a circumferential water supply chamber defined between the operational periphery of the ring and the operational portion of the drum;

(iv) water sealing means extending between the ring and the drum to minimise water leakage from the chamber;

(v) a water delivery port provided in the or each water delivery arm for supplying water from a remote supply source to the chamber; and (vi) a water distribution network of the drum in water flow communication with the chamber.

Thus, the water supply system in accordance with the first aspect of the invention, adopts the principal of providing water entry to and through the outside of the selected drum(s) itself, rather than through the drive shaft in accordance with the prior art proposal, so that the water leakage, that will inevitably occur at some time or other due to seal wear or failure or design, is of little consequence, as it can have no damaging effect on other components of the mining machine, as the leakage is external of that drum(s), merely falling to the mine floor. Hence relatively low cost seals can be employed without detriment.

The water supply system in accordance with the first aspect may be retro-fitted to existing mining machines.

In one embodiment, the operational portion of the drum is a plain, arcuate periphery of the drum. In another embodiment, the operational portion of the drum is a circumferential groove provided in a portion of the arcuate periphery of the drum.

In principle, the sealing means may be static, supported from the ring, and in sliding sealing engagement with the drum, or alternatively the sealing means may be rotary, supported from the drum, and in sliding sealing engagement with the ring. The sealing means is preferably biased into sealing engagement, and biassing may be effected hydraulically by the water supply system, or mechanically by spring means, or by the resilience of the material of the seal.

The sealing means may comprise a single ring, with opposed sealing arms, or may comprise at least two axially spaced-apart sealing rings which are biassed radially, or generally radially, into sealing engagement. The sealing means may be a one piece component. Alternatively, the sealing means may be formed by fitting two sealing components back to back. In the circumferential groove embodiment, the sealing means at least partially penetrates the circumferential groove and has arms biassed into sealing engagement with the rotating sides of the groove by spring means, or by the resilience of the material of the seal, or hydraulically, e.g. by water pressure within the water supply system. The groove may be provided with hardened wear surfaces or alternatively with replaceable wear elements. It is further preferred for the sealing means and any associated components to be insertable into the groove, and removable e.g. from the groove, as a cartridge.

Water distribution from the chamber may be effected via a distributor ring, which could be of resilient material or which could alternatively be of metallic material, associated with the chamber and having a plurality of static supply ports which are alignable with receiving ports of the drum so that presence or absence of ports provides for phased delivery e.g. over 180° to 270°, typically 240° of rotation, for more economical use of water. Preferably, the distribution ring is hydraulically balanced with water pressure effective on various faces of the ring.

It is also preferred for the water supply chamber to be located adjacent the outermost end of an end drum.

According to a second aspect of the invention there is provided a mining machine of the continuous mining type, comprising a crawler chassis with at least one elevatable drive arm pivotable about a transverse axis, projecting from the front of the chassis and carrying a mineral cutting means comprising a pair of end cutting drums and a central cutting device in the form of either a drum or endless cutting chain, incorporating a water supply system in accordance with the first aspect.

Preferably, the or each water supply arm extends to an end drum.

The or each water supply arm could be an attachment to, or integrated into, the or each drive arm but is/are preferably supplementary to the or each drive arm. In principle, a single water supply arm may be provided extending to one drum with the water then distributed via the drum, or alternatively two water supply arms may extend individually to the two end drums. Preferably, a dished end face ring carrying pick boxes to receive mineral cutter picks, is provided on the terminal end of the drum, or on each end drum.

Preferably, the cartridge incorporates vibration dampening means e.g. dampening rings located in, and projecting from, retaining grooves, so as to isolate the sealing means and the distributor ring from cutting vibrations, and to give a degree of "float" for eccentricity caused by wear or replacement parts e.g. sealing means and/or distributor ring or caused by wear of parts fitted to the machine e.g. shaft bearings.

To permit installation and removal of the sealing means and the distributor ring, the latter are preferably produced in multiple parts e.g. three parts.

The or each water supply arm may be provided with pressurized water at 50 to 1000 p.s.i. or higher (typically 500 p.s.i.) e.g. from an on-board water pump driven by a power take off from the diesel engine of the mining machine, or an electric motor, of the continuous miner. Alternatively, a static water supply e.g. at 400 p.s.i may be available in the mine.

Provided access is available for instance to an end of an end drum, then the ring at the terminal end of the or each water supply arm may be of one piece construction. However, for a mining machine having three co-axial cutting drums viz. a centre drum and two outer drums, then for the centre drum, and optionally for the outer drums, the ring must be split, e.g. at joints 180° apart, to permit ready assembly and disassembly of the ring with respect to, particularly, the centre drum.

The invention will now be further described, in greater detail, by way of example, with reference to the accompanying drawings, in which.

Figure 4:
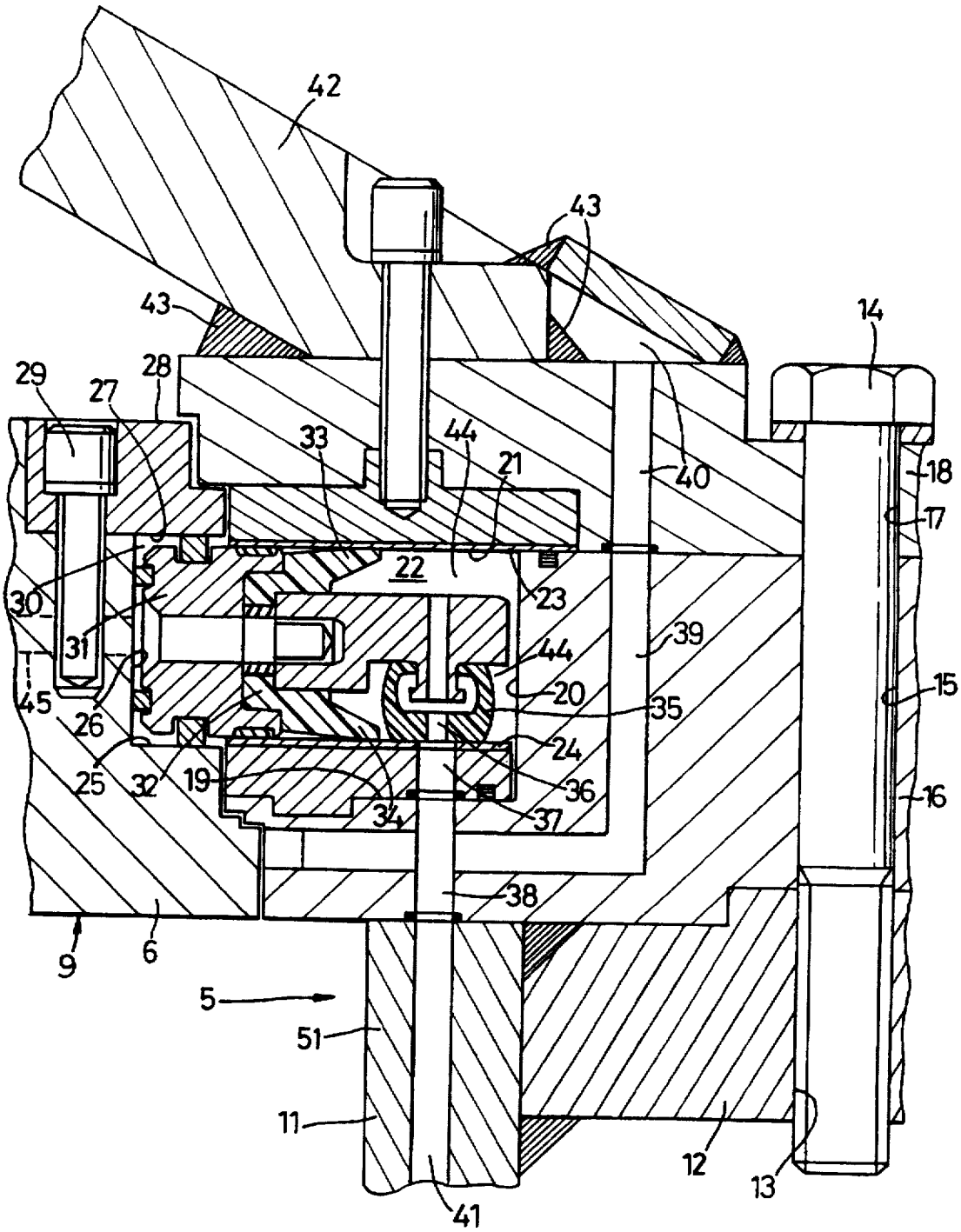
FIG. 4 is a detailed sectional view of a first embodiment of the water supply system of FIGS. 1 to 3.
Figure 5:
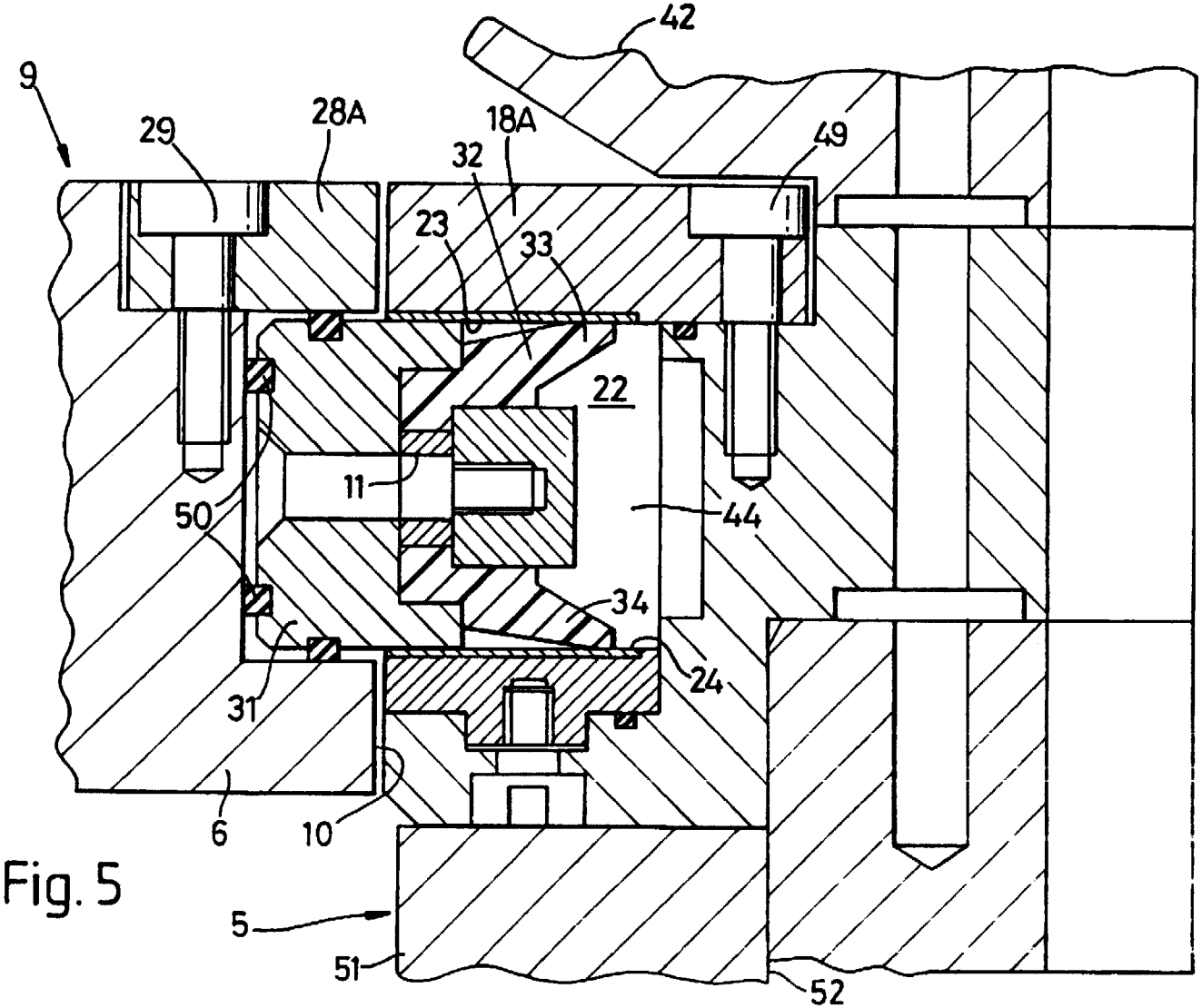
Figure 6:
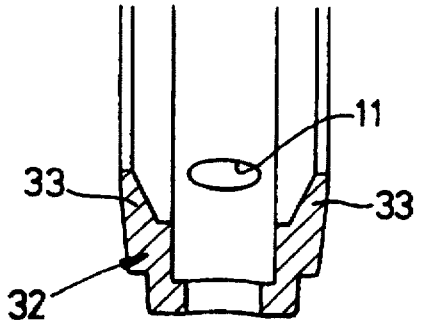
Figure 7:
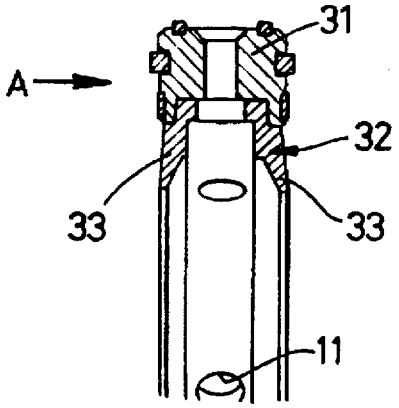
Figure 10:
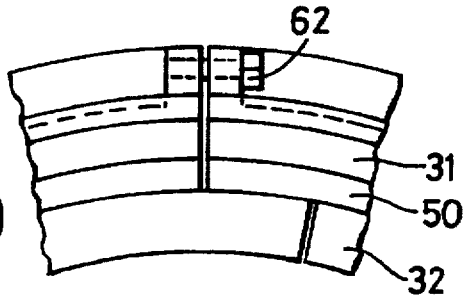
Figure 11:
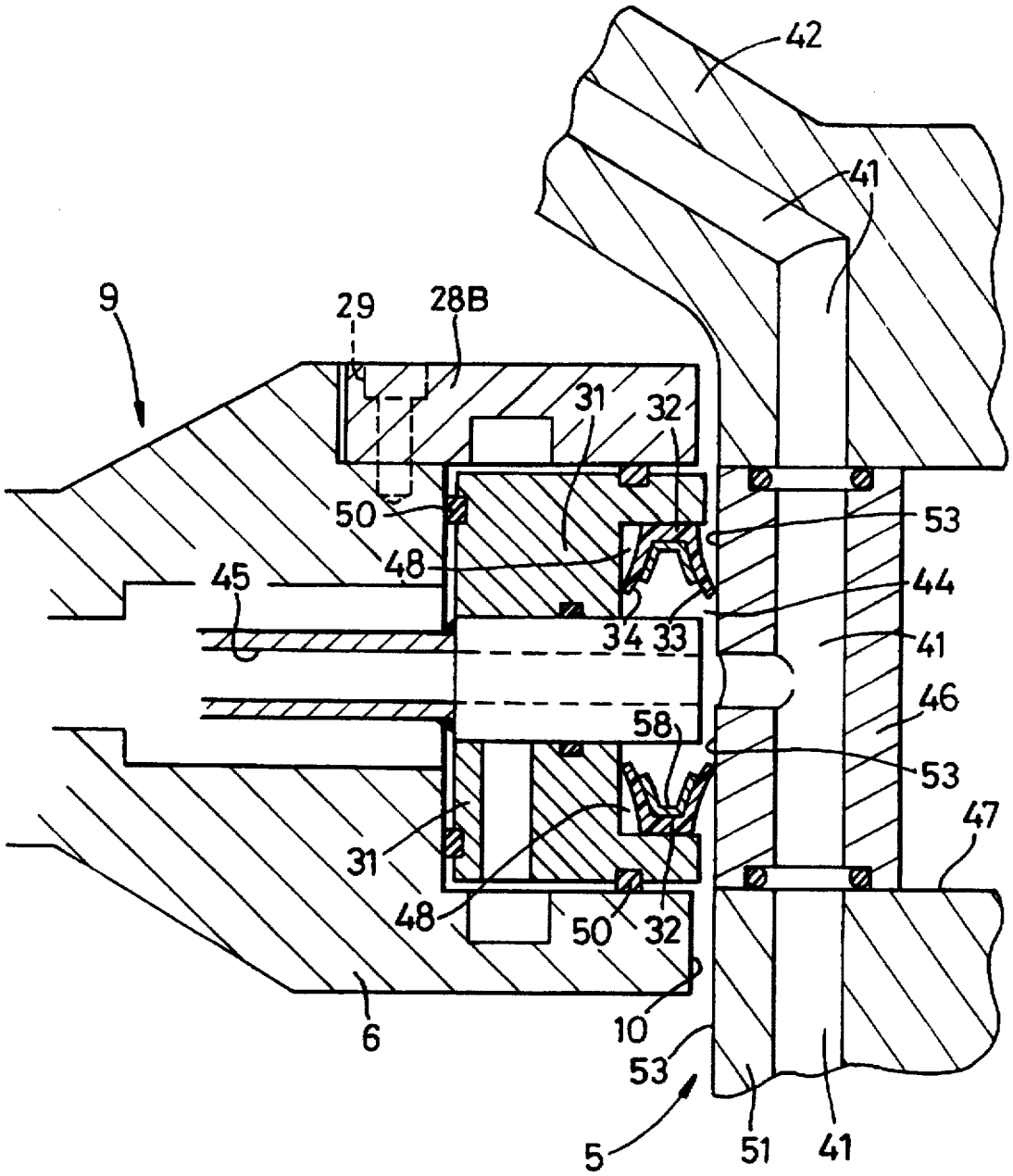
Figure 12:
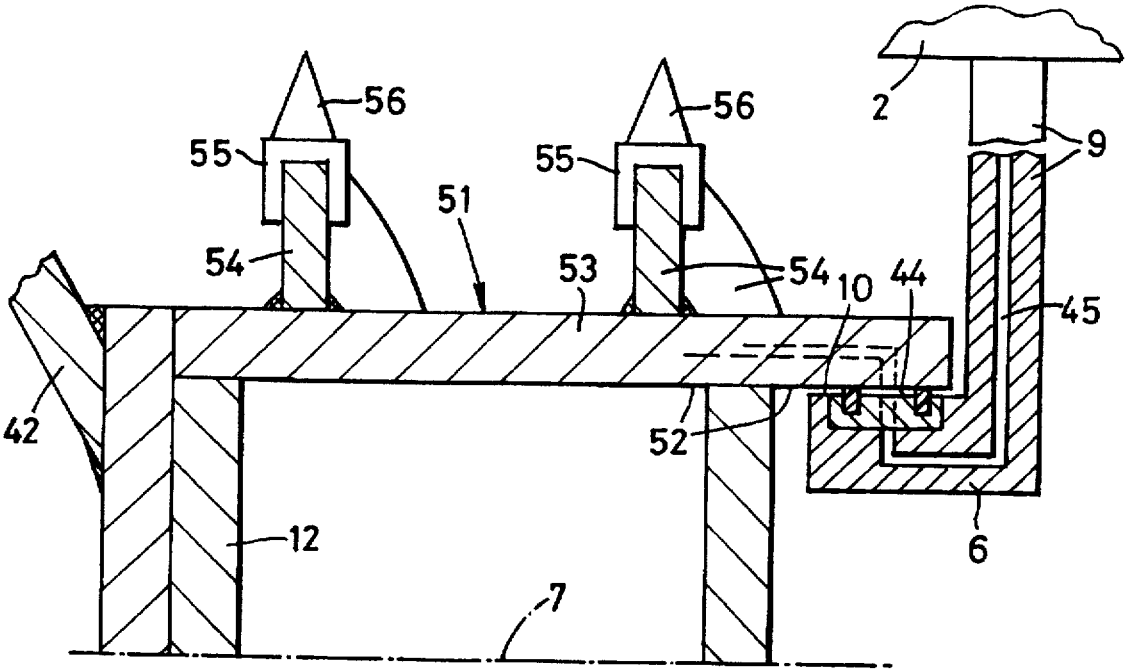

FIG. 5 corresponds to FIG. 4, but shows a second embodiment;

FIGS. 6 to 9 are various views of the circumferential seal of FIG. 4;

FIG. 10 is a view in the direction of arrow A of FIG. 7 of an embodiment of splittable sealing means;

FIG. 11 corresponds to FIG. 4, but shows a third embodiment;

FIG. 12 corresponds to FIG. 11, but shows a variant thereof; and

Figure 13:
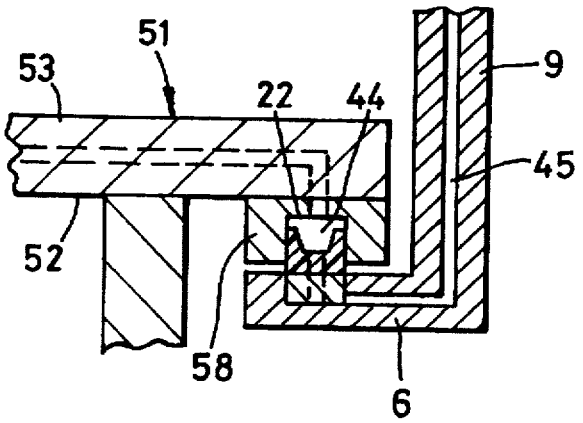

FIG. 13 corresponds to a portion of FIG. 12 but shows another variant.

Figure 1:
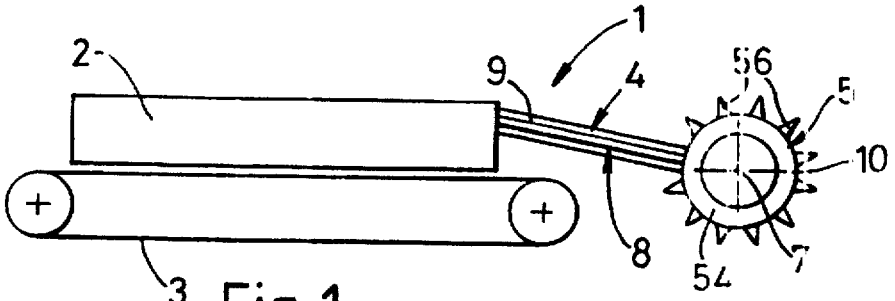
FIG. 1 is a diagrammatic side elevation of a mining machine in accordance with the second aspect incorporating a water supply system in accordance with the first aspect.
Figure 2:
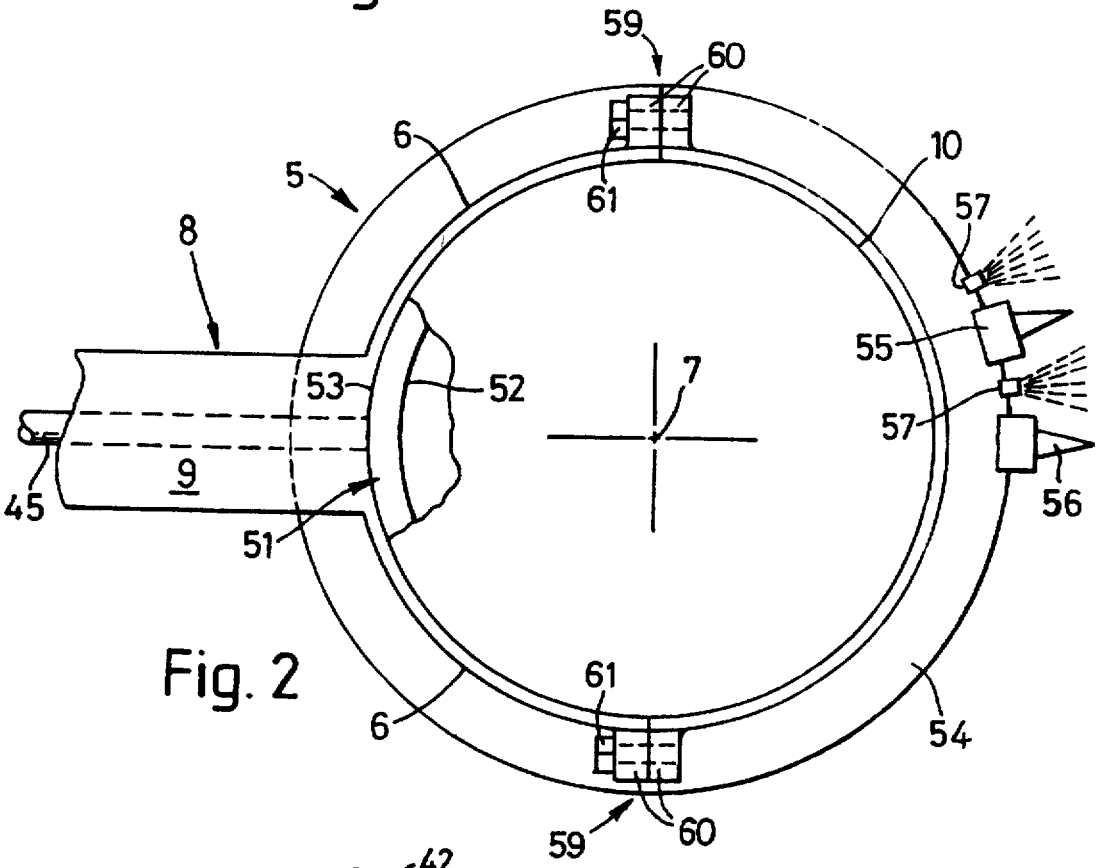
FIG. 2 is an enlarged side elevation of the end portion of one cutting drum of FIG. 1.
Figure 3:
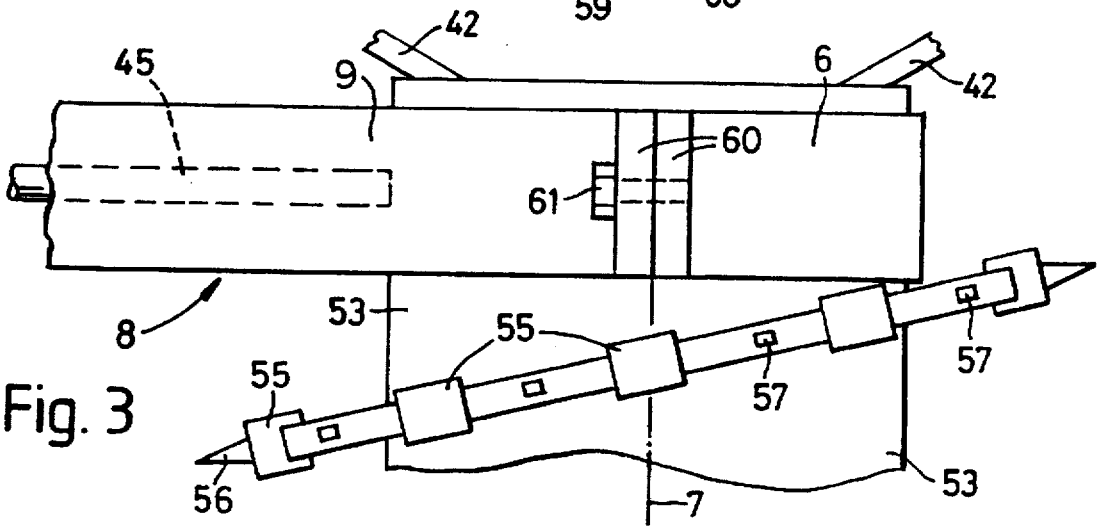
FIG. 3 is a plan view of part of FIG. 2.

In FIG. 1 is illustrated an industry-standard mining machine 1 of the so-called continuous miner type comprising a chassis 2 mounted on crawler tracks 3 by which the machine is manoeuvrable on a mine floor. The machine is provided with an elevatable drive arm 4 carrying a power train to a drum 5 rotatable about a transverse axis 7. Conventionally, the drum 5 comprises a barrel 51 having an arcuate internal periphery 52 (FIG. 4) and an arcuate external periphery 53. Around the external periphery 53 is welded at least one helical vane 54, onto which is welded a series of pick boxes 55 adapted to receive a mineral cutter pick 56. Also carried by the vane 54, or sometimes the pick boxes 55, is a series of water spray nozzles 57. Conventionally, with a single drive arm 4 two drums 5 would be provided, extending to opposite sides of the drive arm 4, while with a pair of parallel drive arms 4 three drums 5 would be provided, or the centre drum could be replaced by an endless chain.

In order to supply water to the drum(s) 5 for purposes such as dust suppression, pre-start warning etc. the machine 1 is fitted with a water supply system 8 comprising at least one, and preferably two, water supply arms 9 extending forwardly from the chassis 2 to the drum 5 and terminating in a ring 6 having an internal periphery 10 adapted to be in close proximity with a portion of the arcuate internal periphery 52 or external periphery 53 of the drum 5 and specifically of the drum barrel 51. The water supply arm 9 is provided with pressurized water e.g. from an on-board water pump (not shown) driven by a prime mover (not shown) of the machine 1, or by the static water pressure available in the mine the water being conveyed along conduits (not shown) within the arm 9.

As illustrated in FIG. 4, the barrel 51 is closed off by a disc-like end plate 12 provided with an array of tapped holes 13 around a circumference to receive a corresponding array of threaded studs 14 passing through a plain bore 15 in an intermediate plate 16 and a plain bore 17 in an outer plate 18, the studs 14 serving to clamp the plates 16 and 18 to the plate 12 and hence to the drum 5.

The intermediate plate 16 is provided with a circumferential rebate defined by walls 19 and 20 which, together with the adjacent face 21 of the outer plate 18 defines a circumferential, U-shaped groove 22. Specifically, the face 21 is defined by a replaceable wear plate 23 while a similar wear plate 24 is located opposite the plate 23.

The ring 6 is similarly provided with a rebate defined by walls 25 and 26 which, together with a wall 27 provided by a clamping collar 28 secured by studs 29 defines another U-shaped groove 30 in which is located a static carrier 31 for a water sealing means in the form of a circumscribing, static, annular seal 32, which partially penetrates the groove 22 and has resilient arms 33 and 34 respectively to engage wear plates 23 and 24, in a sliding water-sealing manner. The seal 32 together with the groove 22 defines a circumferential water supply chamber 44.

Pressurized water is conveyed along the arm 9 to the chamber 44 by port 45 being sealed within the chamber 44 by the annular seal 32, while water is distributed from the chamber 44 by a resilient distributor ring 35, which is also static, and which is provided with a plurality of individual supply ports 36 which are alignable with receiving ports 37 which rotate with the drum about its axis 7. The ports 37 are in communication with a porting network 38, 39, 40, 41 to convey water to various parts of the drum 5. Also, as illustrated in FIG. 4 the plate 18 is provided with a dished, end face ring 42 secured by welds 43, the ring 42 carrying additional pick boxes and picks (not shown).

In the embodiment of FIG. 5, like reference numerals are used for like components of the FIG. 4 embodiment, FIG. 5 indicating that the groove 22 may be opened up by removal of studs 49 securing an annular end plate 18A, and similarly the studs 29 securing the clamping collar 28A so that when replacement of the seal 32 is necessary e.g. due to wear, the components 31, 32 may be removed as a cartridge, with fresh components 31, 32 replaced as a cartridge.

FIGS. 6 to 10 provide further details of the seal 32, and shows a series of through holes 11 by which water may enter the chamber 44 from the ring 6.

The embodiment of FIG. 11 differs from those of FIGS. 4 and 5 in that no groove is provided. In contrast, the circumferential water supply chamber 44 is defined by a portion of the plain external periphery 53 of the drum 5 and specifically of a ring 46 inset between end 47 of the jacket 51 and the pick-carrying end face ring 42, and a pair of axially spaced-apart circumscribing static seals 32 mounted in a carrier 31 and in sliding water-sealing engagement with the arcuate external periphery 53 of the ring 46. The seals 32 may be provided with radial grooves, whereby pressurised water supplied via port 45 to the chamber 44, may pass to zone 48 behind the seals 32 to biass the latter into sealing engagement with surface 10, but the seals 32 as illustrated have "U"-springs 58.

The arm 9 is provided with a removable closure ring 28B whereby access may be gained to the carrier 31 and seals 32, for insertion and removal of these components, as a cartridge.

The embodiment of FIG. 12 differs from FIG. 11 in that the portion of the barrel 51 forming part of the chamber 44 is the internal plain surface 52.

In the embodiment of FIG. 13 the internal surface 52 is not plain but groove 22 is provided, preferably in an internal ring 58 secured around the plain surface 52.

In all embodiments, the carrier 31 is provided with vibration dampening rings 50.

Figure 8:
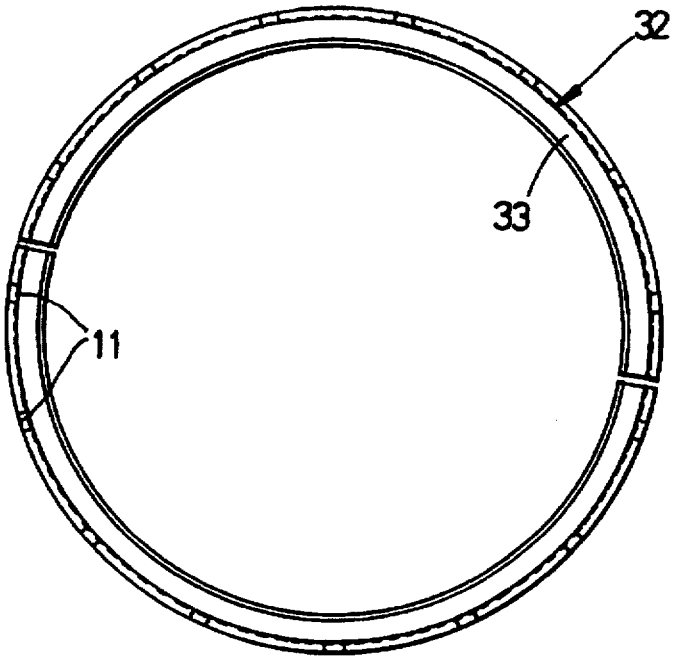
Figure 9:
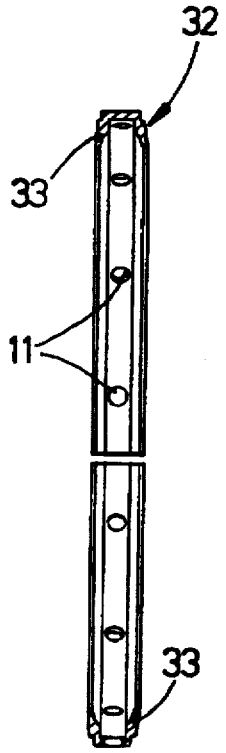

For a mining machine 1 having three co-axial cutting drums 5, being a centre drum and two outer drums, then for the centre drum, and optionally for the outer drums, the ring 6 may be split at joints 59 180° apart, each joint comprising a pair of bosses 60 and a releasable securing stud 61, to permit ready assembly and disassembly of the splittable ring 6 with respect to, particularly, the centre drum 5. As illustrated in FIGS. 8 to 10, it is also necessary to split the seal 32 and its carrier 31, as illustrated in FIG. 9, again with a releasable securing stud 62.

I claim:

1. A water supply system (8) for a mining machine (1) of the continuous miner type, said system comprising:

(i) at least one rotatable mineral cutting drum (5) having a free end terminating in an end face ring (42);

(ii) at least one water supply arm (9) adapted, in use, to extend forwardly from said mining machine (1) to a portion of said cutting drum (5);

(iii) a circumferential water supply chamber (22) defined between said arm (9) and an operational portion (53,52) of said drum (5);

(iv) water sealing means (32) extending between said arm (9) and said drum (5) to minimize water leakage;

(v) a water delivery port (45) provided in said one water supply arm (9) for supplying water from a remote supply source to said drum (5); and (vi) a water distribution network (39,40,41) of said drum (5) in water flow communication with said drum (5), characterized in that said water supply arm (9) is interposed between said free end of the drum (5) and said end face ring (42).

2. A system as claimed in claim 1, wherein said water supply arm (9) terminates in a ring (6), an internal or external operational periphery (10) of which ring (6) is in close proximity respectively to an external or internal portion (53,52) of said operational portion of said cutting drum (5).

3. A system as claimed in claim 2, wherein said operational portion (53,52) of the drum (5) is a plain, arcuate periphery of said drum (5).

4. A system as claimed in claim 2, wherein said operational portion (53,52) of said drum (5) is a circumferential groove (22) provided in a portion of said arcuate periphery (10) of said drum (5).

5. A system as claimed in claim 4, wherein said sealing means (32) at least partially penetrates said circumferential groove (22) and has arms (33,34) biased into sealing engagement with rotating sides of said groove (22).

6. A system as claimed in claim 4, wherein said groove (22) is provided with hardened wear surfaces.

7. A system as claimed in claim 4, wherein said groove (22) is provided with replaceable wear elements (23,24).

8. A system as claimed in claim 2, wherein said sealing means (32) is static, is supported from said ring (6), and is in sliding sealing engagement with said drum (5).

9. A system as claimed in claim 2, wherein said sealing means (32) is rotary, is supported from said drum (5), and is in sliding sealing engagement with said ring (6).

10. A system as claimed in claim 2, wherein said with opposed sealing means (32) comprises a single ring, with opposed sealing arms (33,34).

11. A system as claimed in claim 2, wherein said sealing means (32) comprises at least two axially spaced apart sealing rings (32) which are biased radially into sealing engagement.

12. A system as claimed in claim 2, wherein said ring (6) is of a split construction, as is said water sealing means (23).

13. A system as claimed in claim 1, wherein said sealing means (32) is biased into sealing engagement.

14. A system as claimed in claim 13, wherein said sealing means (32) is biased hydraulically by the water of said water supply system into sealing engagement.

15. A system as claimed in claim 13, wherein said sealing means (32) is biased mechanically by spring means into sealing engagement.

16. A system as claimed in claim 13, wherein said sealing means (32) is biased by resilience of the material of said sealing means (33,34) into sealing engagement.

17. A system as claimed in claim 1, wherein said sealing means (23) and any associated components is/are insertable and removable as a cartridge.

18. A system as claimed in claim 17, wherein said cartridge incorporates vibration dampening means (50).

19. A system as claimed in claim 1, wherein water distribution from said chamber (22) is effected via a distributor ring (35) associated with said chamber (22) and having a plurality of axially extending, static supply ports (36), which are alienable with receiving ports (37,38) of said drum (5) so that presence or absence of ports (37,38) provides for phased water delivery over an arc.

20. A system as claimed in claim 17, wherein said distribution ring (35) is hydraulically balanced with water pressure effective on various faces of the ring.

21. A system as claimed in claim 1, wherein said chamber (22) is located adjacent the outermost end of a mineral cutter drum (5) which is an end drum.

22. A mining machine of the continuous mining type, comprising a crawler chassis (2) with a pair of spaced-apart, elevatable drive arms (4) pivotable about a common transverse axis, projecting from the front of the chassis (2) and carrying a mineral cutting means comprising a pair of end cutting drums (5) and a central cutting device, wherein at least one of said end cutting drums (5) is provided with a water supply system (8) comprising:

(i) at least one rotatable mineral cutting drum (5) having a free end terminating in an end face ring (42);

(ii) at least one water supply arm (9) adapted, in use, to extend forwardly from said mining machine (1) to a portion of said cutting drum (5);

(iii) a circumferential water supply chamber (22) defined between said arm (9) and an operational portion (53,52) of said drum (5);

(iv) water sealing means (32) extending between said arm (9) and said drum (5) to minimize water leakage;

(v) a water delivery port (45) provided in said one water supply arm (9) for supplying water from a remote supply source to said drum (5); and (vi) a water distribution network (39,40,41) of said drum (5) in water flow communication with said drum (5), characterized in that said water supply arm (9) is interposed between said free end of the drum (5) and said end face ring (42).

23. A machine as claimed in claim 22, wherein said water supply arm (9) extends to an end drum (5).

24. A machine as claimed in claim 22, wherein said water supply arm (9) is attached externally to, or integrated internally into, at least one of said drive arms (4).

25. A machine as claimed in claim 22, wherein said water supply arm (9) is supplementary to at least one of said drive arms (4).

26. A machine as claimed in claim 22, wherein a single water supply arm (9) is provided extending to one of said drums (5), with the water then distributed to at least one other of said drums (5).

27. A machine as claimed in claim 22, wherein two water supply arms (9) are provided extending, individually, to two end drums (5).

28. A machine as claimed in claim 22, wherein a dished end face ring (42) is provided at a free end of an end drum (5), beyond said water supply arm (9).

* * * * *